US007335086B1

(12) United States Patent
Karon

(10) Patent No.: US 7,335,086 B1
(45) Date of Patent: Feb. 26, 2008

(54) STRAPLESS AND BACKLESS ADHESIVE BRASSIERE

(76) Inventor: Hylton Karon, Unit 1, 525 Denison Street, Markham, Ontario (CA) L3R 1B8

( * ) Notice: Subject to any disclaimer, the term of this patent is extended or adjusted under 35 U.S.C. 154(b) by 0 days.

(21) Appl. No.: 11/510,447

(22) Filed: Aug. 28, 2006

(51) Int. Cl.
*A41C 3/06* (2006.01)
*A41C 3/10* (2006.01)

(52) U.S. Cl. ..... 450/81; 450/1; 450/86; 450/88; 450/54

(58) Field of Classification Search ..... 450/81, 450/1, 86, 88, 41–45, 54–58
See application file for complete search history.

(56) References Cited

U.S. PATENT DOCUMENTS

| | | | | |
|---|---|---|---|---|
| 6,231,424 | B1 * | 5/2001 | Valentin | 450/81 |
| 6,257,952 | B1 * | 7/2001 | Valentin | 450/81 |
| 6,336,839 | B1 * | 1/2002 | Valli | 450/1 |
| 6,383,055 | B2 * | 5/2002 | Valentin | 450/81 |
| 6,814,648 | B2 * | 11/2004 | Chong | 450/81 |

* cited by examiner

*Primary Examiner*—Gloria M. Hale

(57) ABSTRACT

A brassiere having no shoulder straps and no back strap is disclosed. The brassiere comprises a pair of connected breast cups. The brassiere further comprises a pair of side panels comprised of a substantially inelastic fabric, wherein each side panel is coupled to a lateral side of a breast cup. The brassiere further comprises an adhesive disposed on a proximal side of each breast cup and side panel for adhering the brassiere to a wearer.

18 Claims, 6 Drawing Sheets

STRAPLESS AND BACKLESS ADHESIVE BRASSIERE

CROSS-REFERENCE TO RELATED APPLICATIONS

Not Applicable.

STATEMENT REGARDING FEDERALLY SPONSORED RESEARCH OR DEVELOPMENT

Not Applicable.

INCORPORATION BY REFERENCE OF MATERIAL SUBMITTED ON A COMPACT DISC

Not Applicable.

FIELD OF THE INVENTION

This invention relates to the field of brassieres, and more particularly to improved features for strapless and backless adhesive brassieres.

BACKGROUND OF THE INVENTION

The female breasts have very little internal support, being composed largely of adipose tissue or fat. It is believed that the primary anatomical support for the breast is provided by the Cooper's ligaments, with the skin covering the breasts offering some additional support. However, this anatomical support is usually insufficient to hold the breasts up (especially in older women), and to prevent movement of the breasts, which can cause pain and discomfort. Thus, the primary reason for wearing a brassiere or similar foundation garment is to provide external support for the breasts, increasing comfort and mobility. Brassieres are also believed by some to help preserve the youthful shape of breasts (which naturally sag as women grow older).

A brassiere consists of cups for the breasts, a center panel, and a band running around the body under the bust. Unless a brassiere is a strapless brassiere, it will also include a shoulder strap at each side. A brassiere is typically made of a fabric such as cotton or lace, with the cups for the breasts given shape by underwires or plastic reinforcements. The brassiere is usually fastened with a hook fastener on the band, typically at the back, but in some embodiments the fastener is situated at the front, in between the cups.

A range of styles of brassieres exist, to be worn in a variety of situations. Strapless brassieres, for example, have no shoulder straps and are designed for wearing with clothes that reveal the shoulders, such as halterneck tops. Backless brassieres, otherwise known as adhesive bras, have no back strap and include an adhesive on the proximal side of the brassiere so as to adhere the item to the wearer's skin. Adhesive brassieres are designed for wearing with backless dresses that reveal the wearer's back.

One problem with adhesive brassieres is that they are typically constructed of an elastic material. This also applies to the side panels of the brassiere, which are used to adhere the brassiere to the sides of the wearer's body. As the elastic side panels are applied to the wearer's skin on the sides of her body using her hands, the side panels can be stretched due to their elastic quality. When the side panels are released by the wearer's hands, the side panels retract or return to their original shape and thereby pull on the wearer's skin.

This phenomenon has the affect of pulling the skin on the sides of the wearer's body toward the centerline of the brassiere and her body. This is not desirable, since it may be uncomfortable and may produce indentations in fatty areas in the skin on the sides of the wearer's body.

Another problem with adhesive brassieres is that the side panels do not fit all types of outfits. As explained above, adhesive brassieres are designed for wearing with backless dresses that reveal the wearer's back and portions of the sides of her body. If the side panels of the brassiere are too long, they may extend beyond the area covered by the dress, thereby exposing the brassiere. This is a drawback of the current adhesive brassiere design since it is desirable and fashionable to hide the fact that a user is wearing a brassiere.

Therefore, a need exists to overcome the problems with the prior art as discussed above, and particularly for an improved backless and strapless adhesive brassiere.

SUMMARY OF THE INVENTION

Briefly, according to an embodiment of the present invention, a brassiere having no shoulder straps and no back strap is disclosed. The brassiere comprises a pair of connected breast cups. The brassiere further comprises a pair of side panels comprised of a substantially inelastic fabric, wherein each side panel is coupled to a lateral side of a breast cup. The brassiere further comprises an adhesive disposed on a proximal side of each breast cup and side panel for adhering the brassiere to a wearer.

In another embodiment of the present invention, a brassiere having no shoulder straps and no back strap is disclosed. The brassiere comprises a first portion of fabric forming two breast cups and two side panels, wherein each side panel is coupled to a lateral side of a breast cup. The brassiere further comprises a substantially inelastic portion of fabric integrated into each side panel. The brassiere further comprises an adhesive disposed on a proximal side of each breast cup and side panel for adhering the brassiere to a wearer.

In another embodiment of the present invention, a brassiere having no shoulder straps and no back strap is disclosed. The brassiere comprises a first side panel connected to a lateral side of a first breast cup, wherein the first side panel is comprised of a substantially inelastic fabric. The brassiere further comprises a second side panel connected to a lateral side of a second breast cup, wherein the first side panel is comprised of a substantially inelastic fabric and wherein the first breast cup is connected to the second breast cup. The brassiere further comprises at least one indicator located on each side panel, wherein each indicator indicates where a side panel may be trimmed. The brassiere further comprises an adhesive disposed on a proximal side of each breast cup and side panel for adhering the brassiere to a wearer.

The foregoing and other features and advantages of the present invention will be apparent from the following more particular description of the preferred embodiments of the invention, as illustrated in the accompanying drawings.

BRIEF DESCRIPTION OF THE DRAWINGS

The subject matter, which is regarded as the invention, is particularly pointed out and distinctly claimed in the claims at the conclusion of the specification. The foregoing and other features and also the advantages of the invention will be apparent from the following detailed description taken in conjunction with the accompanying drawings. Additionally, the left-most digit of a reference number identifies the drawing in which the reference number first appears.

DETAILED DESCRIPTION

Figure 1:
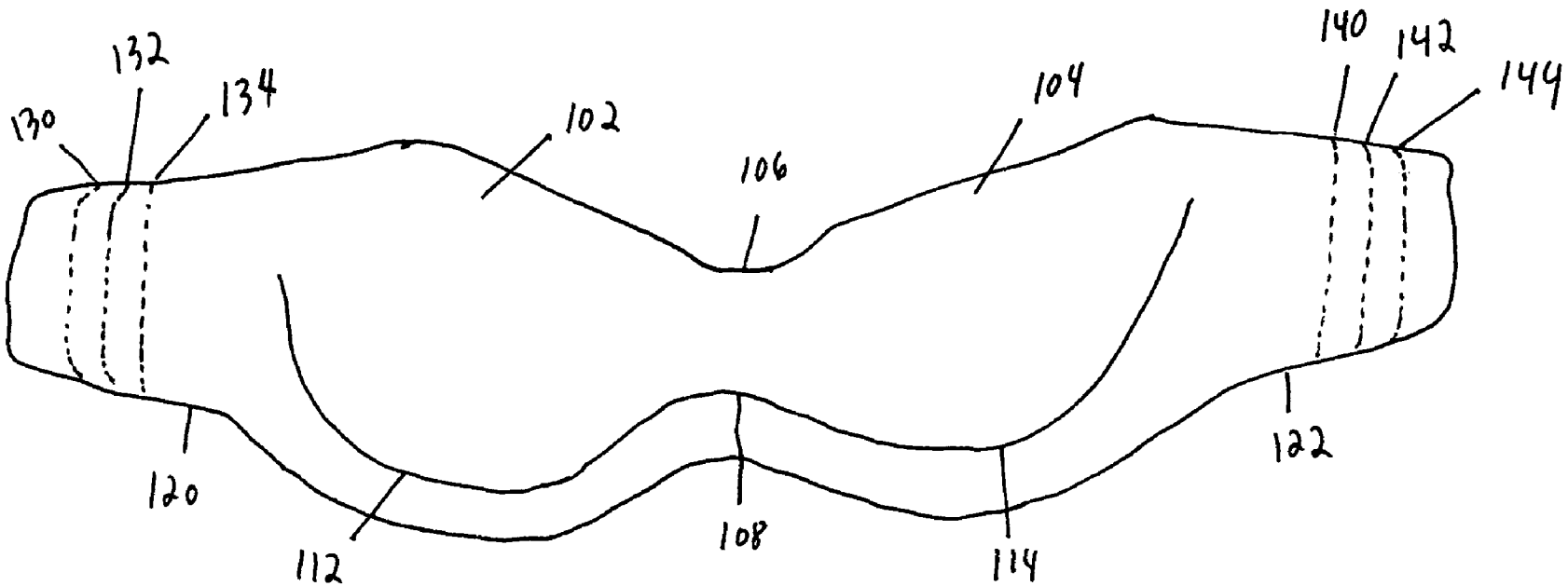
FIG. 1 is an illustration of a frontal view of a backless and strapless adhesive brassiere according to one embodiment of the present invention.

FIG. 1 is an illustration of a frontal view of a backless and strapless adhesive brassiere 100 according to one embodiment of the present invention. Note that brassiere 100 includes no shoulder straps and back strap. The brassiere 100, however, includes an adhesive (not shown in FIG. 1) on the proximal side (i.e., the side of the brassiere 100 that contacts the skin of the wearer) of the brassiere 100, thereby adhering the brassiere 100 to the body of the wearer. The brassiere 100 may be comprised of a combination of elastic and inelastic fabrics. The type of fabric used to construct brassiere 100 is described in more detail below.

FIG. 1 shows the brassiere 100 including a first breast cup 102 and a second breast cup 104, wherein each breast cup encloses a woman's breast and thereby provides support for the breast. Also shown in FIG. 1 is a connector 106 that couples breast cup 102 with breast cup 104. Coupled to a lateral side of the breast cup 102 is a side panel 120 comprising an inelastic fabric. Likewise, coupled to a lateral side of the breast cup 104 is a side panel 122 also comprising an inelastic fabric. When the brassiere 100 is worn, each side panel 120, 122 extends to a lateral side (i.e., left or right side) of the body of the wearer. Each side panel 120, 122 provides an additional surface area of the brassiere 100 that is adhered to the body of the wearer using an adhesive, thereby providing supplementary support for the breasts of the wearer.

In an embodiment of the present invention, an underwire 108 is integrated into the bottom portion 112 of breast cup 102 and the bottom portion 114 of breast cup 104. An underwire is a curved or undulating portion of generally inflexible material, such as plastic or metal, which reinforces the shape of the brassiere 100 as well as providing structural support for the breasts of the wearer. When the brassiere 100 is worn, the underwire 108 lies flat against the rib cage of the wearer and underneath the breasts of the wearer. In an embodiment of the present invention, the underwire 108 is located within the fabric or layers of fabric that comprise the brassiere 100 such that the underwire 108 is completely enclosed by fabric and is not exposed.

FIG. 1 further shows vertical indicators 130, 132 and 134 located on side panel 120 and vertical indicators 140, 142 and 144 located on side panel 122. Recall that a drawback of the prior art is that side panels in adhesive brassieres may be too long or irregularly shaped and thereby may not be covered by the wearer's backless dress or garment. The purpose of each vertical indicator 130, 132, 134, 140, 142, 144 isto indicate where aside panel may be trimmed so asto maintain the brassiere 100 hidden beneath the wearer's dress or garment. Each vertical indicator is shaped such that the general form of the tip of each side panel 120, 122 is maintained, albeit shorter in length. Thus, the vertical indicators guide a user in trimming the side panels 120, 122 so as to fit the shape of the user's garment.

A vertical indicator 130, 132, 134, 140, 142, 144 can take a variety of forms. For example, a vertical indicator can be a perforation comprising a series of holes or orifices that penetrate all or a portion of the fabric or fabrics that comprise the brassiere 100. A perforation may allow a user to rip the brassiere 100 along the perforation using her hands alone. A vertical indicator may further be a depressed stamp that causes a depression or an indentation in the fabric or fabrics that comprise the brassiere 100. A vertical indicator may further be a stitching, a colored mark or a crease that may allow a user to cut slice along the vertical indicator using a tool such as a scissor.

Figure 2:
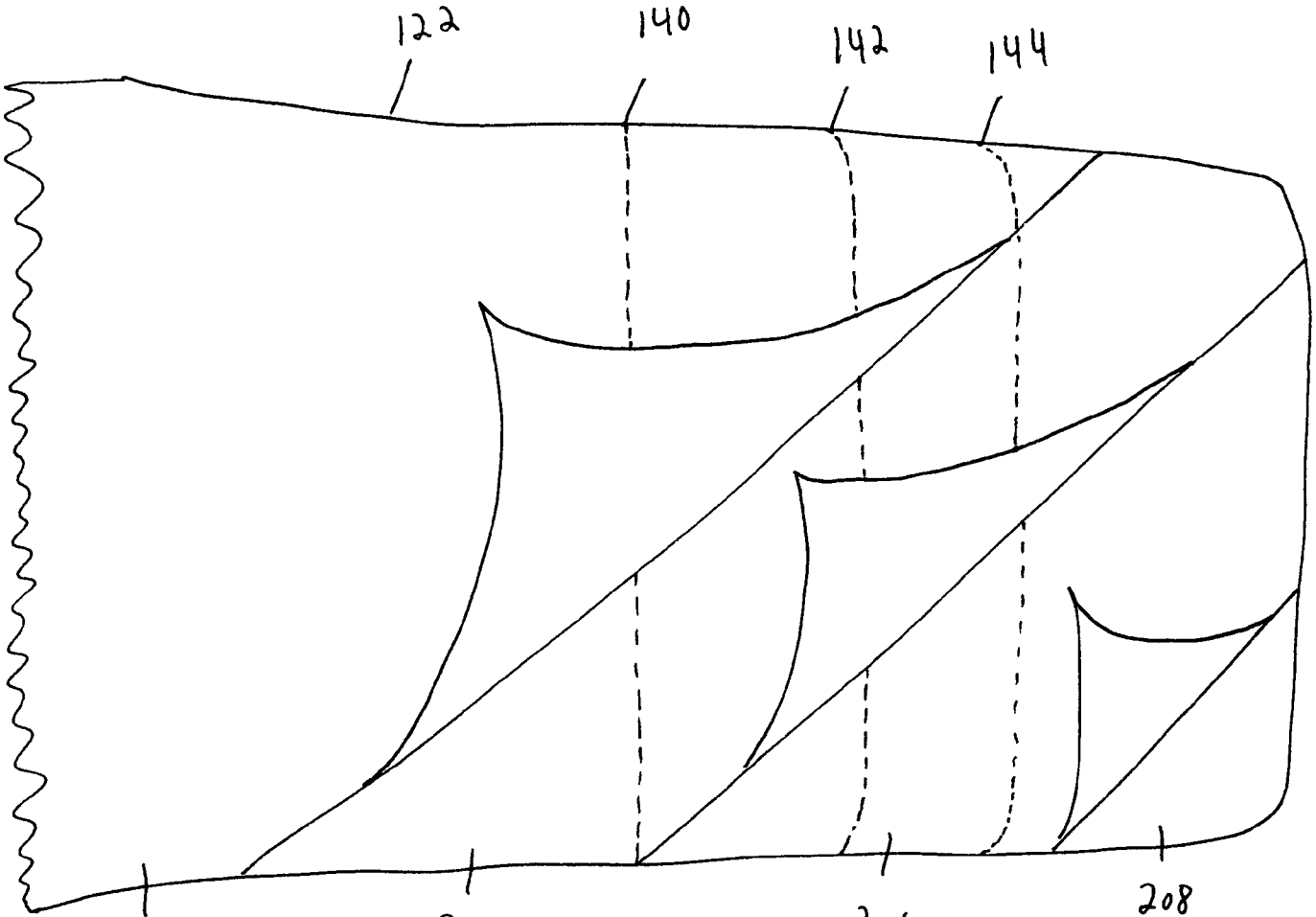
FIG. 2 is a more detailed illustration of a frontal view of a side panel of the brassiere of FIG. 1.

FIG. 2 is a more detailed illustration of a frontal view of a side panel 122 of the brassiere 100 of FIG. 1. FIG. 2 shows the various layers of fabric that may comprise the side panel 122 of the brassiere 100. FIG. 2 shows a first layer of fabric 202 located on the distal side of the brassier 100 (i.e., the side facing away from the wearer of the brassiere 100). The fabric 202 may comprise an elastic fabric such as spandex or elastane, which is a synthetic fiber known for its elasticity. Spandex or elastane is a manufactured fiber in which the fiber-forming substance is a long chain synthetic polymer comprised of at least 85 percent of a segmented polyurethane. Spandex is spun from a block copolymer and its fibers exploit the high crystallinity and hardness of polyurethane segments, yet remain "rubbery" due to alternating segments of polyethylene glycol. The fabric 202 may further comprise a synthetic blend fiber fabric exhibiting elastic characteristics.

FIG. 2 further shows a second layer of fabric 204 comprising a substantially inelastic fabric. Fabric 204 can be a woven or non-woven fabric comprising, cotton, cotton blend, synthetic, or synthetic blend of material. Fabrics 202 and 204 may be attached or coupled using an adhesive. In one embodiment of the present invention, disposed between fabrics 202 and 204 is a layer of foam rubber, which provides thickness to the side panel 122 so as to appear soft or plush to the touch. FIG. 2 further shows a third layer of fabric 206 comprising a substantially inelastic fabric similar or identical to fabric 204. Fabrics 204 and 206 may be attached or coupled using an adhesive.

Also shown in FIG. 2 is a fourth layer of fabric 208 located on the proximal side of the brassiere 100 (i.e., the side facing the wearer of the brassiere 100). The fabric 208 may comprise an elastic fabric similar or identical to fabric 202. Fabrics 206 and 208 may be attached or coupled using an adhesive. In one embodiment of the present invention, disposed between fabrics 206 and 208 is a layer of foam rubber.

Figure 3:
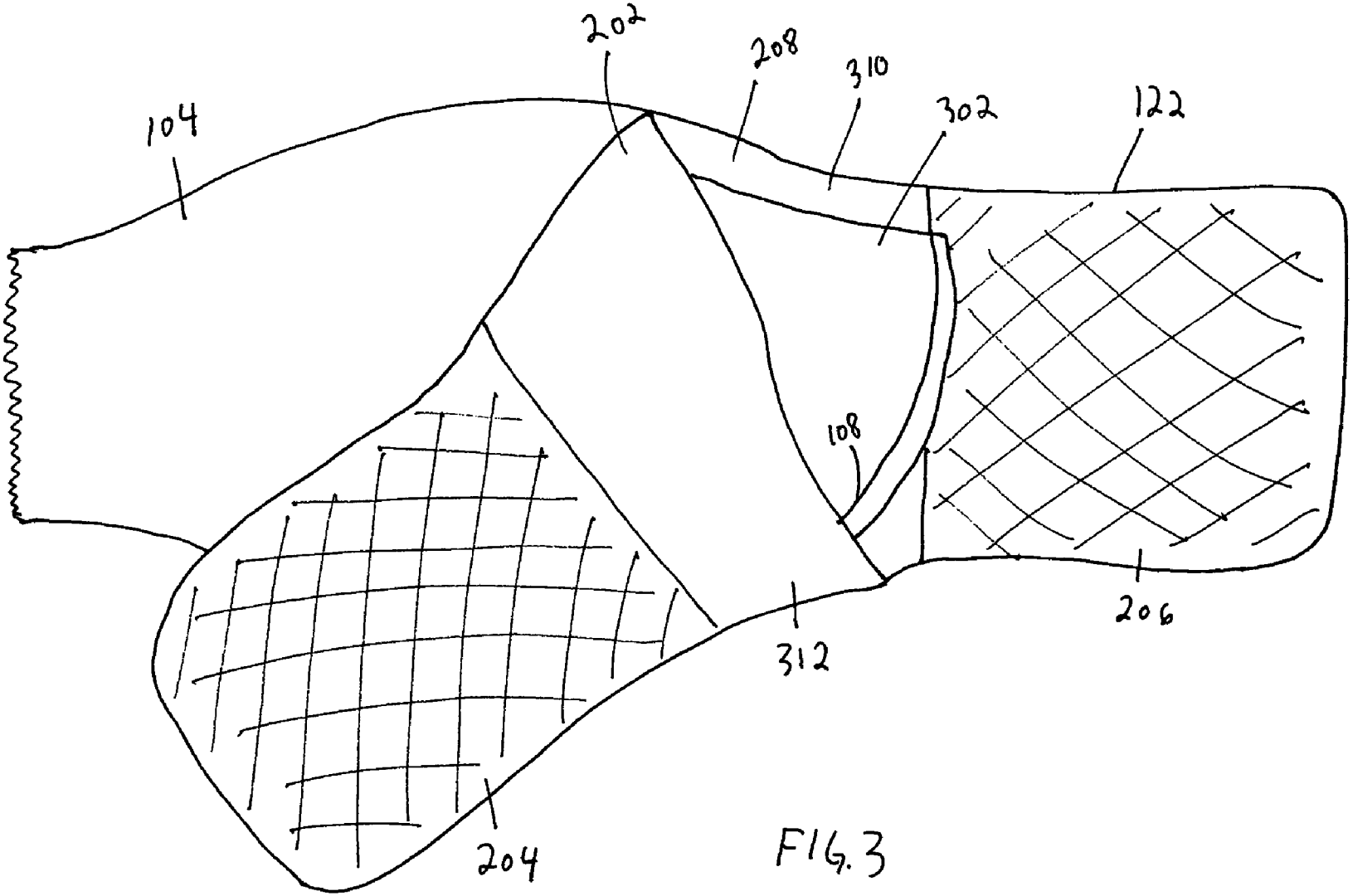
FIG. 3 is a more detailed illustration of a frontal view of the brassiere of FIG. 1.

FIG. 3 is a more detailed illustration of a frontal view of the brassiere 100 of FIG. 1. FIG. 3 shows the various components that may comprise the brassiere 100. As shown more fully in FIG. 2 with respect to side panel 122, FIG. 3 shows the fabric 202 disposed on top of fabric 204, which is disposed on top of fabric 206, which is further disposed on top of fabric 208 (not shown). FIG. 3 further shows that layers of fabric 204 and 206 extend only the length of the side panel 122 and thereby do not lend their inelastic qualities to the rest of the brassiere 100. As a result of the size of fabrics 204 and 206, fabrics 202 and 208 contact each other directly in certain areas, such as areas 310 and 312.

Fabrics 202 and 208 may be attached or coupled using an adhesive. In an embodiment of the present invention, disposed between fabrics 202 and 208 in areas 310 and 312 is a layer of foam rubber.

FIG. 3 further shows an inner breast cup 302 consisting of a foam rubber element formed in the shape of a breast and substantially enclosed between fabrics 202 and 208 so as to form the breast cup 104 of the brassiere 100. Inner breast cup 302 may be enclosed between fabrics 202 and 208 using an adhesive. Also shown in FIG. 3 is the form of underwire 108 located within the inner breast cup 302.

Figure 4:
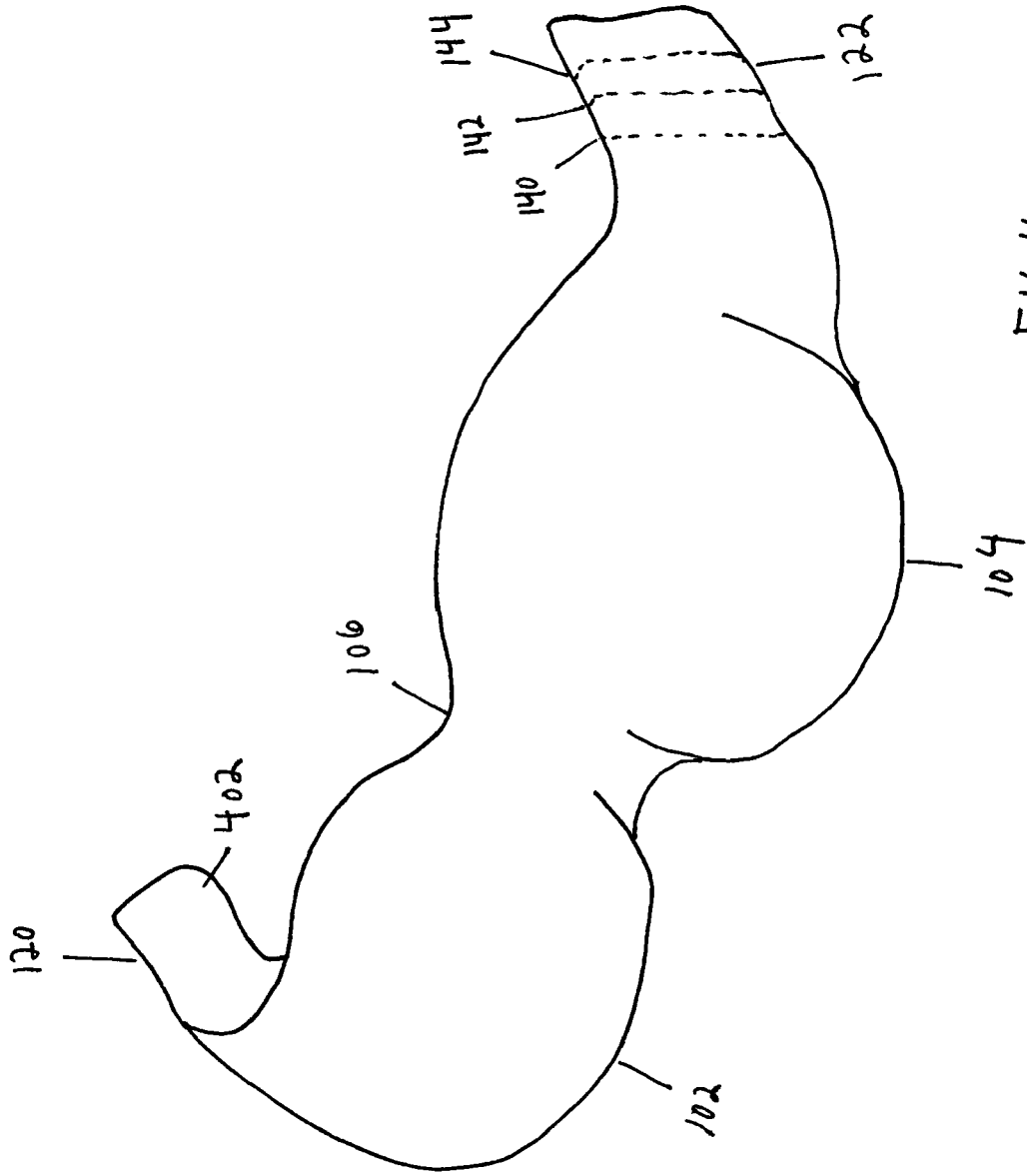
FIG. 4 is an illustration of a frontal perspective view of the brassiere of FIG. 1.

FIG. 4 is an illustration of a frontal perspective view of the brassiere 100 of FIG. 1. FIG. 4 shows the brassiere 100 in a wraparound configuration illustrating the manner in which the brassiere 100 would appear if it were worn by a woman. FIG. 4 shows the left breast cup 102, the right breast cup 104, the connector 106, the left side panel 120 and the right side panel 122. The right side panel 122 shows vertical indicators 140, 142, 144. Also shown is the rear or proximal side 402 of the brassiere 100, which includes an adhesive layer that is used to adhere the brassiere 100 to the wearer's body.

Figure 5:
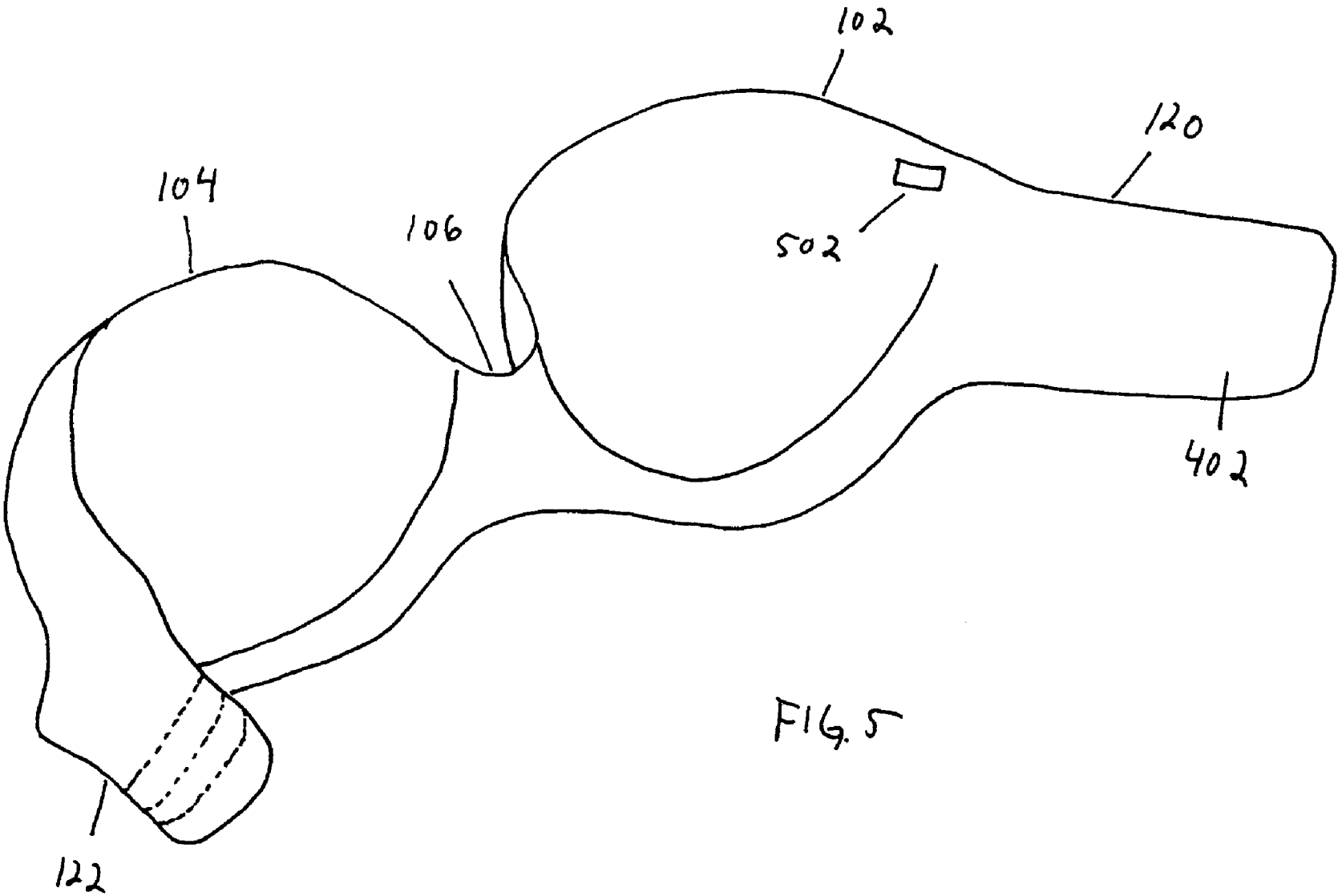
FIG. 5 is an illustration of a rear perspective view of the brassiere of FIG. 1.

FIG. 5 is an illustration of a rear perspective view of the brassiere 100 of FIG. 1. FIG. 5 shows the brassiere 100 in a wraparound configuration illustrating the manner in which the brassiere 100 would appear if it were worn by a woman. FIG. 5 shows the left breast cup 102, the right breast cup 104, the connector 106, the left side panel 120 and the right side panel 122. Also shown is the rear or proximal side 402 of the brassiere 100, which includes an adhesive layer that is used to adhere the brassiere 100 to the wearer's body. Further shown in FIG. 5 is a loop of fabric 502 used for attaching a shoulder strap to the brassiere 100. The use of the loop of fabric 502 is described in greater detail below.

Figure 6:
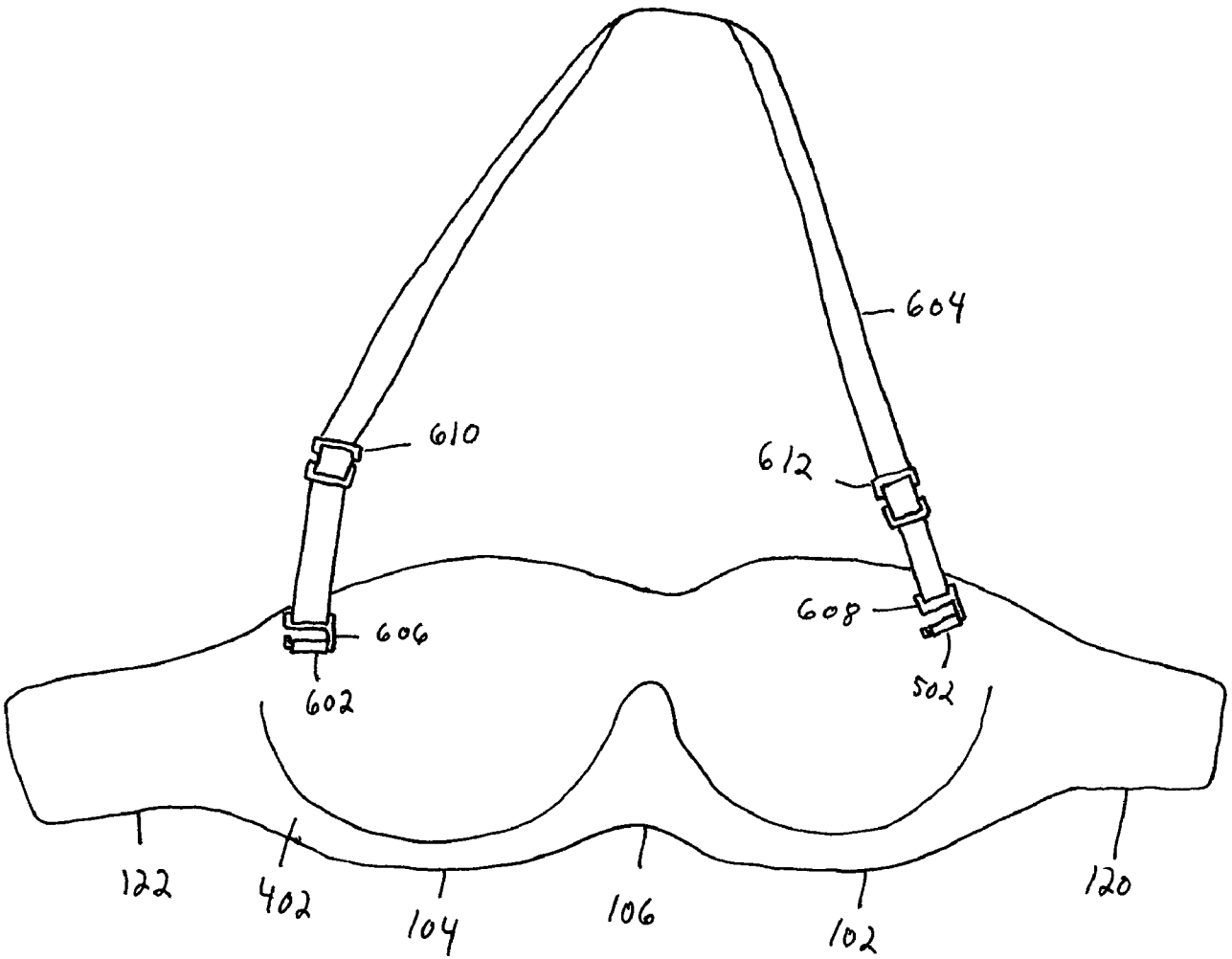
FIG. 6 is an illustration of a rear view of the brassiere of FIG. 1.

FIG. 6 is an illustration of a rear view of the brassiere 100 of FIG. 1. FIG. 6 shows the left breast cup 102, the right breast cup 104, the connector 106, the left side panel 120 and the right side panel 122. Also shown is the rear or proximal side 402 of the brassiere 100, which includes an adhesive layer. Further shown in FIG. 5 is a loop of fabric 502 and a loop of fabric 602 used for attaching a shoulder strap 604 to the brassiere 100. A removable hook 606 attaches the shoulder strap 604 to the loop of fabric 602 while removable hook 608 attaches the shoulder strap 604 to the loop of fabric 502. Adjustment straps 610 and 612 are used to adjust the length of the shoulder strap 604 so as to conform to the size and shape of the wearer. As shown in FIG. 6, the shoulder strap 604 may be removed and replaced at will.

Although specific embodiments of the invention have been disclosed, those having ordinary skill in the art will understand that changes can be made to the specific embodiments without departing from the spirit and scope of the invention. The scope of the invention is not to be restricted, therefore, to the specific embodiments. Furthermore, it is intended that the appended claims cover any and all such applications, modifications, and embodiments within the scope of the present invention.

I claim:

1. A brassiere having no shoulder straps and no back strap, comprising:

a pair of connected breast cups;

a pair of side panels comprised of substantially inelastic and elastic fabric layers, wherein each side panel is coupled to a lateral side of a breast cup and wherein each side panel further comprises at least one vertical indicator structure located on each said panel for identifying where the said panel may be trimmed; and an adhesive disposed on a proximal, inner surface side thereof said brassiere so as to adhere the brassiere to a wearer.

2. The brassiere of claim 1, further comprising an underwire positioned in a bottom portion of the brassiere.

3. The brassiere of claim 1, wherein said elastic layer of fabric is disposed on a proximal, inner surface side of the breast cups and the side panels.

4. The brassiere of claim 3, wherein said elastic layer of fabric is disposed on a distal, outer surface side of the breast cups and the side panels.

5. The brassiere of claim 3, wherein the elastic layer of fabric comprises any one of a synthetic fiber fabric and a synthetic blend fiber fabric.

6. The brassiere of claim 1, wherein the inelastic fabric layer comprises a woven fabric.

7. The brassiere of claim 1, wherein the at least one vertical indicator structure comprises any one of a perforation, depressed stamp, a stitching, a colored mark and a crease.

8. A brassiere having no shoulder straps and no back strap, comprising:

two breast cups and two side panels, wherein each side panel is coupled to a lateral side of a breast cup and wherein each side panel further comprises at least one vertical indicator structure located on each said panel for identifying where the said panel may be trimmed;

a substantially inelastic layer of fabric integrated into each side panel; and an adhesive disposed on a proximal, inner surface side thereof said brassiere for adhering the brassiere to a wearer.

9. The brassiere of claim 8, further comprising an underwire positioned in a bottom portion of the brassiere.

10. The brassiere of claim 8, wherein an additional elastic layer of fabric is disposed on a proximal, inner surface side of the side panels.

11. The brassiere of claim 10, further comprising an additional elastic layer of fabric disposed on a distal, outer surface side of the side panels.

12. The brassiere of claim 10, wherein the first layer of fabric comprises any one of a synthetic fiber fabric and a synthetic blend fiber fabric.

13. The brassiere of claim 9, wherein the inelastic layer of fabric comprises a woven fabric.

14. The brassiere of claim 8, wherein the at least one vertical indicator structure comprises any one of a perforation, a depressed stamp, a stitching, a colored mark and a crease.

15. A brassiere having no shoulder straps and no back strap, comprising:

a first side panel connected to a lateral side of a first breast cup, wherein the first side panel is comprised of substantially inelastic and elastic fabric layers;

a second side panel connected to a lateral side of a second breast cup, wherein the second side panel is comprised of a substantially inelastic and elastic fabric layers and wherein the first breast cup is connected to the second breast cup;

at least one indicator structure located on each side panel, wherein each indicator structure indicates where a side panel may be trimmed; and an adhesive disposed on a proximal, inner surface side thereof said brassiere for adhering the brassiere to a wearer.

16. The brassiere of claim 15, wherein the at least one indicator structure comprises any one of a perforation, a depressed stamp, a stitching, a colored mark and a crease.

17. The brassiere of claim 15, further comprising an underwire positioned in a bottom portion of the brassiere.

18. The brassiere of claim 17, further comprising an additional elastic layer of fabric disposed on a proximal, inner surface side of the side panels.

* * * * *